US008111854B2

(12) United States Patent
Peng

(10) Patent No.: US 8,111,854 B2
(45) Date of Patent: Feb. 7, 2012

(54) METHODS AND APPARATUS FOR SOUND PRODUCTION

(76) Inventor: Yan-Ru Peng, Taipei (TW)

( * ) Notice: Subject to any disclaimer, the term of this patent is extended or adjusted under 35 U.S.C. 154(b) by 878 days.

(21) Appl. No.: 12/003,560

(22) Filed: Dec. 28, 2007

(65) Prior Publication Data

US 2008/0123890 A1 May 29, 2008

Related U.S. Application Data

(63) Continuation-in-part of application No. 11/605,418, filed on Nov. 29, 2006, now abandoned.

(51) Int. Cl.
*H04R 1/20* (2006.01)

(52) U.S. Cl. ..... 381/338; 381/150; 381/370; 381/382

(58) Field of Classification Search ..... 381/74, 381/301, 304–305, 61–64, 150–152, 337–339, 381/370, 374, 382, 322, 328, 380; 181/144, 181/153

See application file for complete search history.

(56) References Cited

U.S. PATENT DOCUMENTS

| | | | | |
|---|---|---|---|---|
| 3,246,721 | A | 4/1966 | Martin | |
| 4,239,945 | A | 12/1980 | Atoji et al. | |
| 4,297,535 | A * | 10/1981 | Hehemann | 381/382 |
| 4,668,842 | A | 5/1987 | Yokoyama | |
| 4,742,887 | A | 5/1988 | Yamagishi | |
| 4,852,177 | A | 7/1989 | Ambrose | |
| 5,208,868 | A | 5/1993 | Sapiejewski | |
| 5,327,178 | A | 7/1994 | McManigal | |
| 5,682,434 | A | 10/1997 | Boyden | |
| 5,694,475 | A | 12/1997 | Boyden | |
| 5,727,077 | A | 3/1998 | Frasl | |
| 6,186,269 | B1 | 2/2001 | Vollmer et al. | |
| 6,356,644 | B1 | 3/2002 | Pollak | |
| 6,431,308 | B1 | 8/2002 | Vollmer et al. | |
| 6,704,429 | B2 | 3/2004 | Lin | |
| 7,388,960 | B2 | 6/2008 | Kuo et al. | |
| 7,436,974 | B2 | 10/2008 | Harper | |
| 7,463,748 | B2 * | 12/2008 | Yang | 381/370 |
| 2002/0186858 | A1 | 12/2002 | Masuda et al. | |
| 2003/0103637 | A1 * | 6/2003 | Huang | 381/309 |
| 2004/0071298 | A1 | 4/2004 | Geeng | |
| 2004/0134710 | A1 | 7/2004 | Yang | |

(Continued)

FOREIGN PATENT DOCUMENTS

| | | |
|---|---|---|
| EP | 1 843 627 | 10/2007 |
| WO | WO 97/11573 | 3/1997 |

OTHER PUBLICATIONS

European Search Report completed on May 16, 2007, in EP06126546.8.

*Primary Examiner* — Vivian Chin
*Assistant Examiner* — Fatimat O Olaniran
(74) *Attorney, Agent, or Firm* — Abraham Hershkovitz; Harold L. Novick; Hershkovitz & Associates, LLC

(57) ABSTRACT

Electrical signals corresponding to sound are received at a wire, and sound is generated at a speaker connected to the wire. The sound is resonated in a cavity of a shell housing the speaker, and then passed along a transmission tube toward a pinna of a user's ear without directing the sound directly toward the user's ear canal.

18 Claims, 8 Drawing Sheets

U.S. PATENT DOCUMENTS

2005/0110644 A1 5/2005 Abramson et al.
2005/0147269 A1 7/2005 Oliveira et al.
2005/0217925 A1 10/2005 Benway
2005/0226453 A1 10/2005 Kamo et al.
2005/0286717 A1 12/2005 Viduya et al.
2006/0198544 A1* 9/2006 Yueh ..... 381/381
2007/0058831 A1 3/2007 Rie
2007/0160245 A1 7/2007 Peng

* cited by examiner

METHODS AND APPARATUS FOR SOUND PRODUCTION

CROSS-REFERENCE TO RELATED APPLICATIONS

This application is a Continuation In Part of U.S. patent application Ser. No. 11/605,418, filed Nov. 29, 2006 now abandoned, the contents of which are hereby incorporated by reference in their entirety.

BACKGROUND OF THE INVENTION

1. Field of the Invention

The present disclosure relates to methods and apparatuses for sound production, and in particular, to methods and apparatuses for producing sound at the ear of the user.

2. Related Art

FIG. 1 shows a diagram of a typical human ear. The outer ear, or pinna, is an irregularly concave cartilaginous member comprised of a number of eminences and depressions which give each ear a distinct shape and form. The helix 1100 is the curved outer rim of the ear; below the helix 1100 is the antihelix 1124, a curved prominence which describes a curve around the concha, a deep cavity containing the entry to the ear canal 1108. The concha is divided into two parts, the upper and lower concha 1128, 1132, by the crux of the helix 1104 which curves around the outside of the ear, and extends inwards at about the vertical midpoint of the ear. The upper concha 1128 lies above the crux of the helix 1104 and below the anti-helix 1124; the lower concha 1132 lies below the crux of the helix 1104 and surrounds the entry to the ear canal 1108. In front of the lower concha 1132 and projecting backwards from the front of the ear is the tragus, 1112 a small semicircular prominence. Opposite the tragus 1112 and separated from it by the deep curvature of the intertragic notch 1116 is the antitragus 1120.

FIG. 2 shows a typical earbud-type headphone 1200, hereinafter referred to as an "earbud." The earbud 1200 is designed to rest snugly inside the ear canal 1108, at least where the ear canal 1108 opens into the lower concha 1132 or even deeper into the ear canal 1108, and is typically designed to fully occlude the ear canal 1108. A speaker (not shown) inside the earbud is typically positioned so as to direct sound waves 1212 directly into the ear canal and toward the middle ear 1216.

An earbud 1200 placed in the ear canal 1108 in this manner has a number of disadvantages.

First, it is noted that such an earbud 1200 creates an unhealthy amount of sound pressure on the middle ear 1216. In particular, not only does the speaker direct sound at the structures of the middle ear, but sound pressure waves reflected inside the ear have nowhere to escape, and continue to echo inside the ear canal 1108 and can repeatedly strike the middle ear 1216. Not only is this unhealthy, but it further creates unintended sounds and sound effects which reduce the quality of audio production.

Second, such an earbud 1200, by fully occluding the ear canal 1108, blocks outside sounds 1204 from entering the ear. This presents a safety risk, as important outside sounds such as traffic sounds and emergency alarms can not be heard when the earbuds 1200 are in use.

Third, such an earbud 1200 is necessarily uncomfortable to a large number of users, since ear canal diameter varies from individual to individual in a large way, while earbuds are often sold in only one or two sizes.

Finally, such an earbud 1200 makes no use of the unique curves and folds of the pinna, which are used in day-to-day hearing to identify sources of sounds, to help separate high and low frequency sounds so that the structures of the inner ear can better distinguish between the two, and to generally form what the typical listener has come to identify as a "realistic" sound. By directing sound linearly into the ear canal 1108, such an earbud 1200 creates an undesirably artificial sound.

It should be noted that other headphones, such as earmuff-style headphones or earcap-style headphones, pose similar disadvantages, including at least full occlusion of the ear canal, an echo surface for sound waves which are reflected at the middle ear, and the unhealthy aiming of sound waves directly at the structures of the middle ear.

SUMMARY OF THE INVENTION

The present subject matter addresses the above concerns by teaching the following methods and apparatuses.

A method for producing sound includes the steps of: receiving electrical signals corresponding to sound at a wire, generating a corresponding sound at a speaker connected to the wire, resonating the sound in a cavity of a shell, and passing sound along a transmission tube toward a pinna of a user's ear. No sound is directed directly toward the user's ear canal.

An apparatus for sound production includes a wire which receives electrical signals corresponding to sound, at least one speaker electrically connected to the wire, which generates sound corresponding to the electrical signals, a shell housing the speaker, a shape of the shell providing at least one resonance cavity for resonating the sound, and a transmission tube which passes the sound toward a pinna of a user's ear without directing the sound directly toward the user's ear canal.

BRIEF DESCRIPTION OF THE DRAWINGS

The features, nature, and advantages of the presently disclosed methods and apparatuses will become more apparent from the detailed description set forth below when taken in conjunction with the drawings in which like reference characters identify corresponding items throughout.

DETAILED DESCRIPTION

Initially, it is noted that aspects of the presently disclosed sound production devices and methods are disclosed is U.S. Patent Application Publication Number 2007/0160245, corresponding to U.S. patent application Ser. No. 11/605,418, of which the present application claims benefit, and which is incorporated herein by reference in its entirety. The present application adds further details and embodiments. In the present application, like numbers correspond to like elements between the present application and the aforesaid U.S. patent application.

Figure 1:
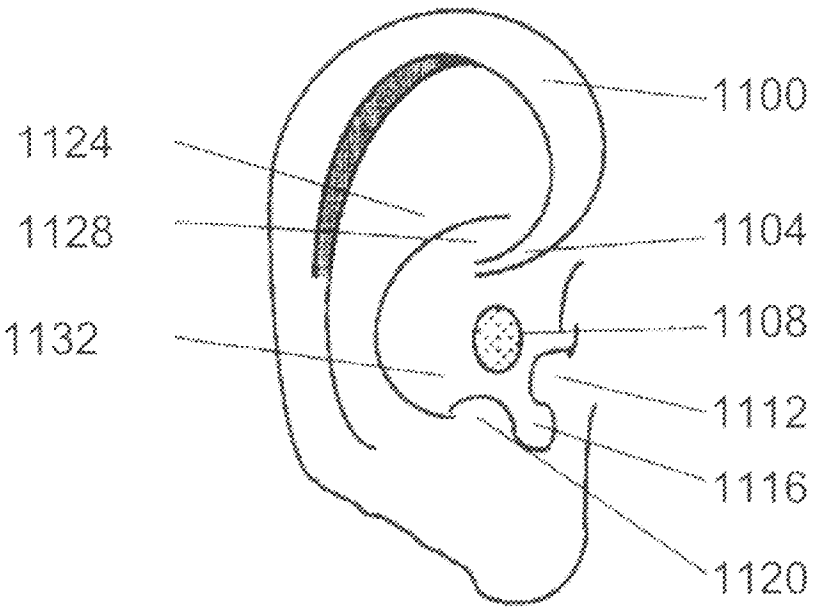
FIG. 1 Prior Art
FIG. 1 is a schematic drawing of a front elevational view of a typical human ear.
Figure 3:
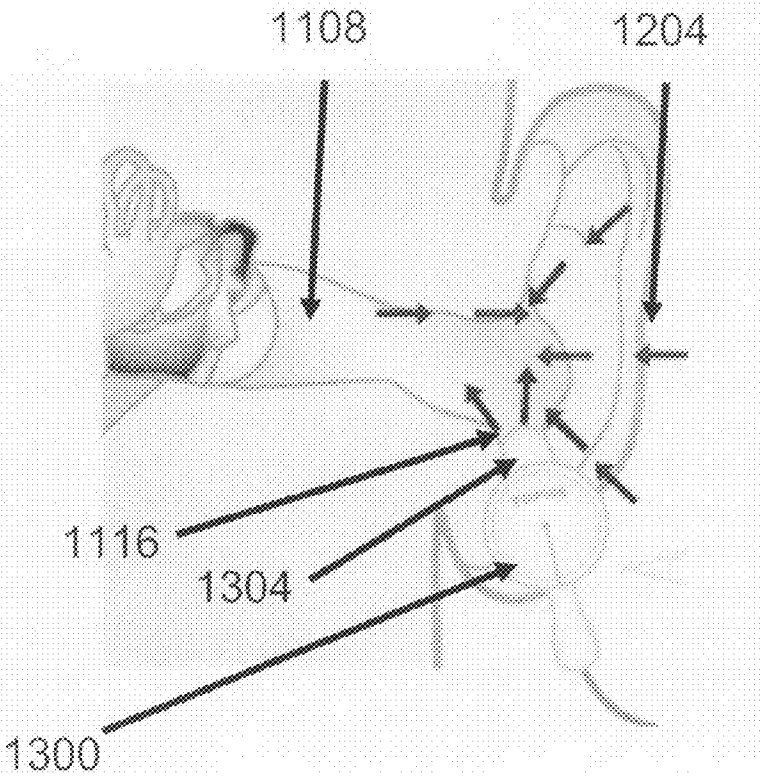
FIG. 3 is a schematic drawing of a front elevational view partially taken in cross-section of a human ear with an embodiment of a sound production device according to the present disclosure mounted at the ear.
Figure 2:
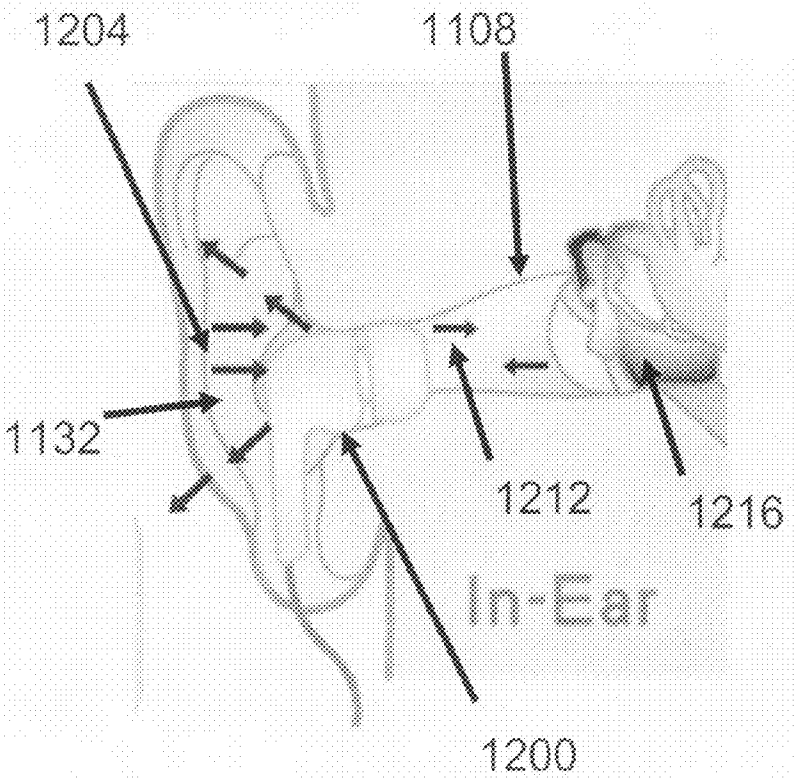
FIG. 2 Prior Art
FIG. 2 is a schematic drawing of a front elevational view partially taken in cross-section of a human ear with a typical prior art earbud-style headphone mounted in the ear canal.

FIG. 3 shows one aspect of a sound production device 1300 according to the present disclosure. Sound production device 1300 directs sound waves through a tube 1304 which rests in an intertragic notch 1116 of a human external ear. Other locations are described in the following paragraphs with reference to the remaining figures. Although only one ear is shown, it is understood that two devices 1300 are typically used, on in each ear, for stereo sound.

Sound production device 1300 differs from the prior art earbud 1200 in a number of important ways.

First, it is noted that sound production device 1300 reduces sound pressure on the middle ear. In particular, sound production device 1300, by virtue of tube 1304, directs sound at the sides of the ear canal, the folds of the pinna, and/or other structures of the outer ear instead at the structures of the middle ear. This reduces the direct pressure produced on the structures of the inner ear.

Second, because sound production device 1300 and tube 1304 do not occlude the ear canal 1108, sound pressure waves reflected inside the ear can escape from the ear. This both further reduces unhealthy pressure on the middle and inner ear and avoids unintended sounds and sound effects from inner-ear echo, thereby improving quality of audio production.

Third, sound production device 1300, by not occluding the ear canal 1108, allows outside sounds 1204 to enter the ear. This improves listener safety, as important outside sounds such as traffic sounds and emergency alarms can now be heard when sound production device 1300 is mounted at the human ear when in use.

Fourth, since sound production device 1300 does not rest inside the ear canal 1108, it does not matter that ear canal diameter varies from individual to individual. Again, sound production device tube 1304 does not rest inside the ear canal 1108 but at its outside. Thus, sound production device 1300 is more comfortable to wear and a single size can be used with a variety of users, avoiding the need to have multiple sizes.

Fifth, as a result of its design, sound production device 1300 produces sound from a smaller aperture and high fidelity audio production can be achieved with less overall sound energy directed at the ear.

Sixth, since sound production device 1300 comprises many structures between the user's ear and the speaker, these structures can be shaped to absorb or transmit particular frequencies of sound. In some aspects, sound energy can be blocked at frequencies ranging from 10 kHz to 20 kHz, which produce harmful pressure in the ear but do not contribute substantially to all listening experiences.

Finally, sound production device 1300 can partially or fully direct sound waves at the unique curves and folds of the pinna, which can give the user the impression of identifying sources of sounds, which can separate high and low frequency sounds so that the structures of the inner ear can better distinguish between the two, and which can generally form what the typical listener has come to identify as a "realistic" sound. By not directing sound linearly into the ear canal 1108, sound production device 1300 creates a desirably realistic sound.

Figure 4:
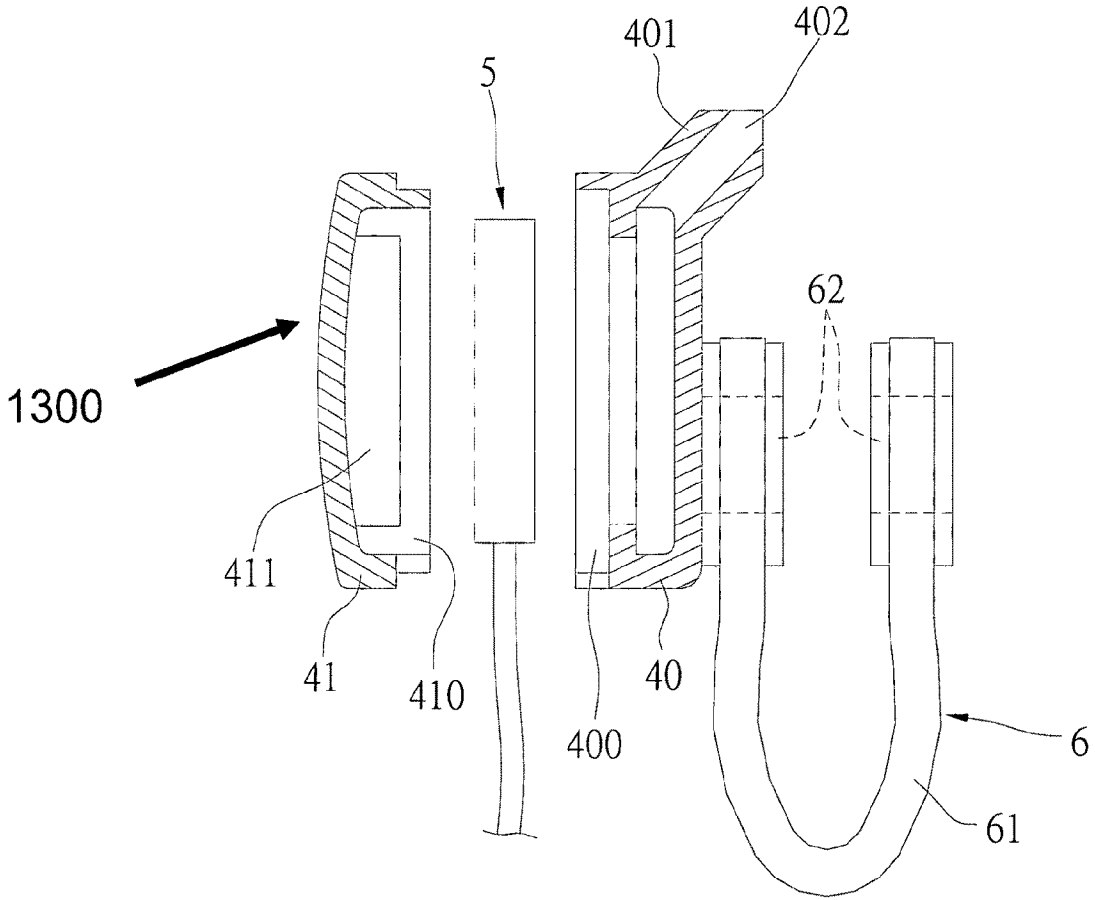
FIG. 4 is an exploded cross-sectional view of an embodiment of a sound production device and a magnetic support according to the present disclosure.

Reference is now made to FIG. 4, which shows parts and features of a sound production device 1300 in detail. This figure can also be found in parent U.S. patent application Ser. No. 11/605,418.

As shown in FIG. 4, sound production device 1300 comprises a speaker 5 within a shell comprising first shell 40 and second shell 41, and a support 6 disposed at the outer side of the shell. Shells 40, 41 are shown separated for ease of disclosure, but it is to be understood that these shells can be connected and/or sealed during manufacture to form a single unit.

First shell 40 is collocated with the second shell 41. The first shell 40 and the second shell 41 can be assembled together in a locking manner, or first shell 40 and second shell 41 can be integrally molded together. First shell 40 surrounds a first space 400, and includes a sound transmission tube 401 extending outwardly from first shell 40. Second shell 41 surrounds a second space 410. Speaker 5 is disposed between first shell 40 and second shell 41, and optionally is disposed near first space 400.

Sound generated by speaker 5 can be directed toward either of first resonance space 400 in first shell 40, or a resonance box 411 within second resonance space 410 of second shell 41. The resonating sound then is emitted from sound reproduction device 1300 along the sound transmission tube 401, and exits at outlet 402 where the sound is directed into the ear.

Although resonance box 411 is depicted, an alternative element to create resonance can be resonance spaces 400, 410 defined by the shells 40, 41 respectively. In this figure, two resonance spaces 400, 410 are described, and these resonance spaces can have unique resonance characteristics; as a non-limiting example, first resonance space 400 can resonate lower frequency sounds relative to those resonated by second resonance space 410, while second resonance space 410 can resonate higher frequency sounds relative to those resonated by first resonance space 400. As a non-limiting example, this can be accomplished by providing shells 40, 41 with different interior shapes, thus changing the resonance characteristics of resonance spaces 400, 410. The shape of shells 40, 41 can be chosen to amplify or deaden certain frequency ranges within the sound reproduction device 1300. Alternatively, although resonance spaces 400, 410 are described separately, it should be understood that they can together form a single resonance space with single resonance space characteristics.

In general, any material can be used for the shell, including plastic, metal, synthetic polymers, silicone, rubber, or rubberized or otherwise pliable materials. The shell can comprise a decorative cap and/or indicia, not shown, on its outer face.

Speaker 5 can be of the typical "diaphragm and coil" variety, or can be a piezoelectric speaker, an electrostatic speaker, a ribbon or planar magnetic speaker, an air motion transducer, a digital speaker, or any other type of device for converting an electrical signal into sound.

Although only one speaker 5 is shown, and although the use of a single speaker in the sound reproduction device 1300 can in many cases be sufficient for excellent sound production, it should be noted that more than one speaker can be disposed inside sound production device 1300. For example, a first speaker of a first diameter can be used to produce low sounds, while a second speaker of a second diameter can be used to produce high sounds. These speakers can be co-located within the sound production device 1300 in any manner. For example, one speaker can face the first shell 40, and the other speaker can face the second shell 41, which can have differing resonance characteristics as described above. Alternatively or additionally, one speaker can rest at the top of the device 1300, nearer the tube, while the other speaker can rest at the bottom of the device 1300, nearer the speaker wire as illustrated.

Although speaker 5 is shown between first shell 40 and second shell 41, it should be noted that the speaker can be attached to either of the first shell 40 or second shell 41 at its external wall, or can in some cases be located partially or fully within the space of the sound transmission tube 401. Although speaker 5 is shown as a generally planar structure which would consequently direct sound perpendicular to the exterior walls of shells 40, 41, it should be noted that speaker 5 can direct sound more toward or away from transmission tube 401.

Transmission tube 401 will be described in more detail with reference to FIGS. 8 and 9 below.

First shell 40 or second shell 41 can be notched for passage of the speaker wire. The speaker wire can exit at any side of the shells 40, 41, or at any angle relative to transmission tube 401. First shell 40 or second shell 41 can comprise a solid outer surface, or can comprise one or more holes for pressure escape, as will be described below.

Also shown is a support 6. Support 6 is comprised of an elongated strap-like silicone member 61 and a pair of magnets 62 mounted at the respective ends of silicone member 61. Through the elasticity of silicone member 61 of support 6, sound reproduction device 1300 is elastically hung on the user's ear and is fixed on the user's ear by the magnetic attraction of the two magnets 62. Support 6 is merely one embodiment of a support, and other supports are described with reference to the following figures, such as the following FIG. 5.

Figure 5:
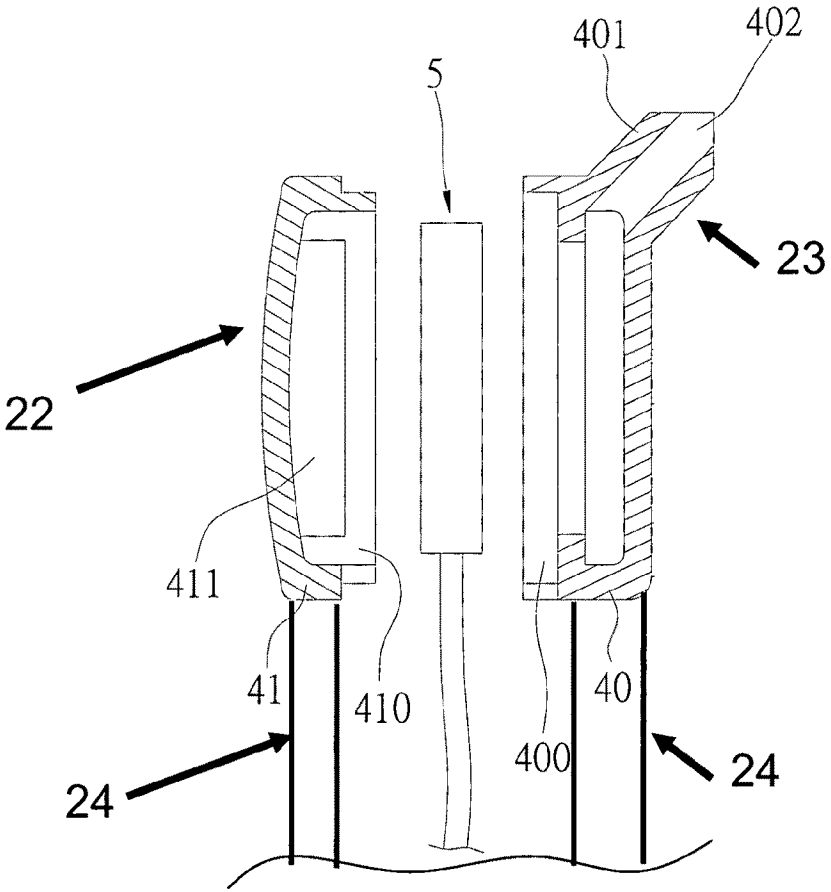
FIG. 5 is an exploded cross-sectional view of an embodiment of a sound production device according to the present disclosure together with a portion of a hook support used to mount the device at the ear of a user.

FIG. 5 shows an alternative support 24 for a sound reproduction device 22, numbered for consistency with corresponding figures in parent U.S. patent application Ser. No. 11/605,418. Here support 24 extends out from the radial edge of the shells 40, 41. Although two support elements are shown, it is understood that a single support 24 can be disposed on either one or the other shell, or that the two support elements can form a single support 24 when shells 40, 41 are joined.

Figure 6:
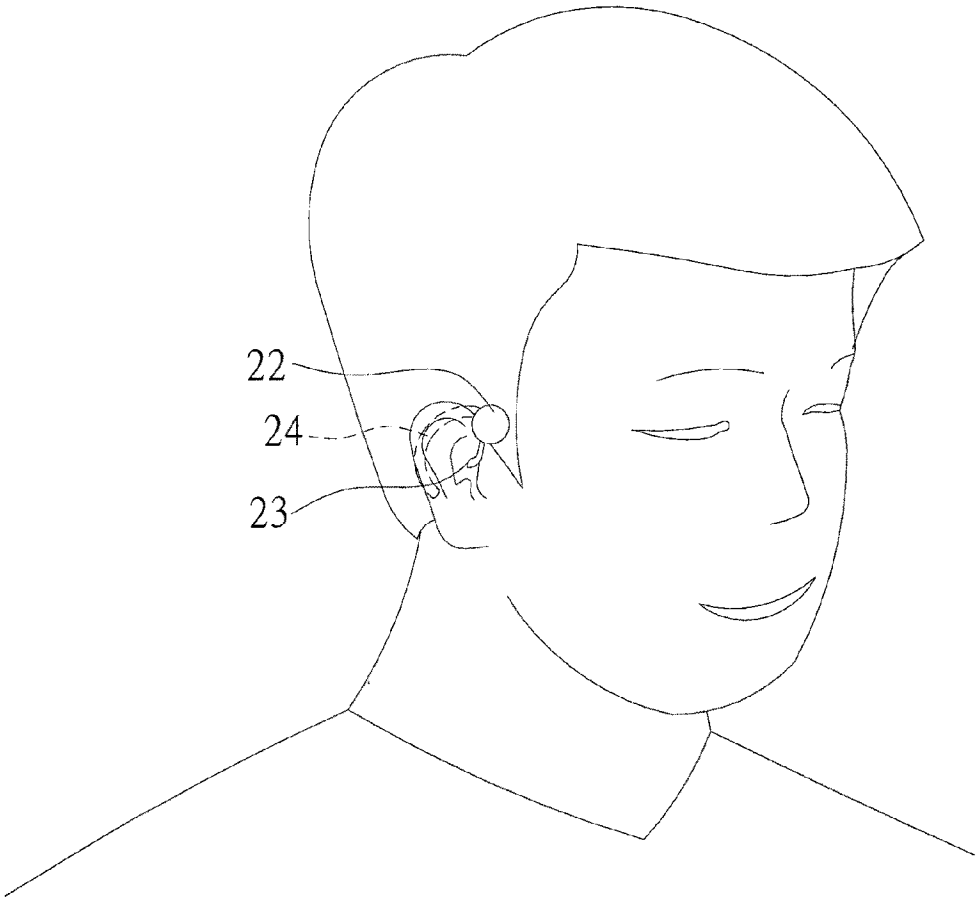
FIG. 6 is a perspective view of a sound production device according to FIG. 5 and shown disposed at an ear.

FIG. 6 is taken from parent U.S. patent application Ser. No. 11/605,418, and illustrates a sound reproduction device 22 disposed at a user's ear. The shell housing of device 22 mounts its speaker not at the bottom of the ear as in FIG. 3, but rather at the top of the ear, and is held in place by support 24. Support 24 curves around the user's ear. Here, transmission tube 23 extends downward, and again does not direct sound directly into the user's ear canal, but rather at structures of the pinna. Transmission tube 23 is shown with a slight curve, but can alternatively extend rigidly toward the ear.

Figure 7:
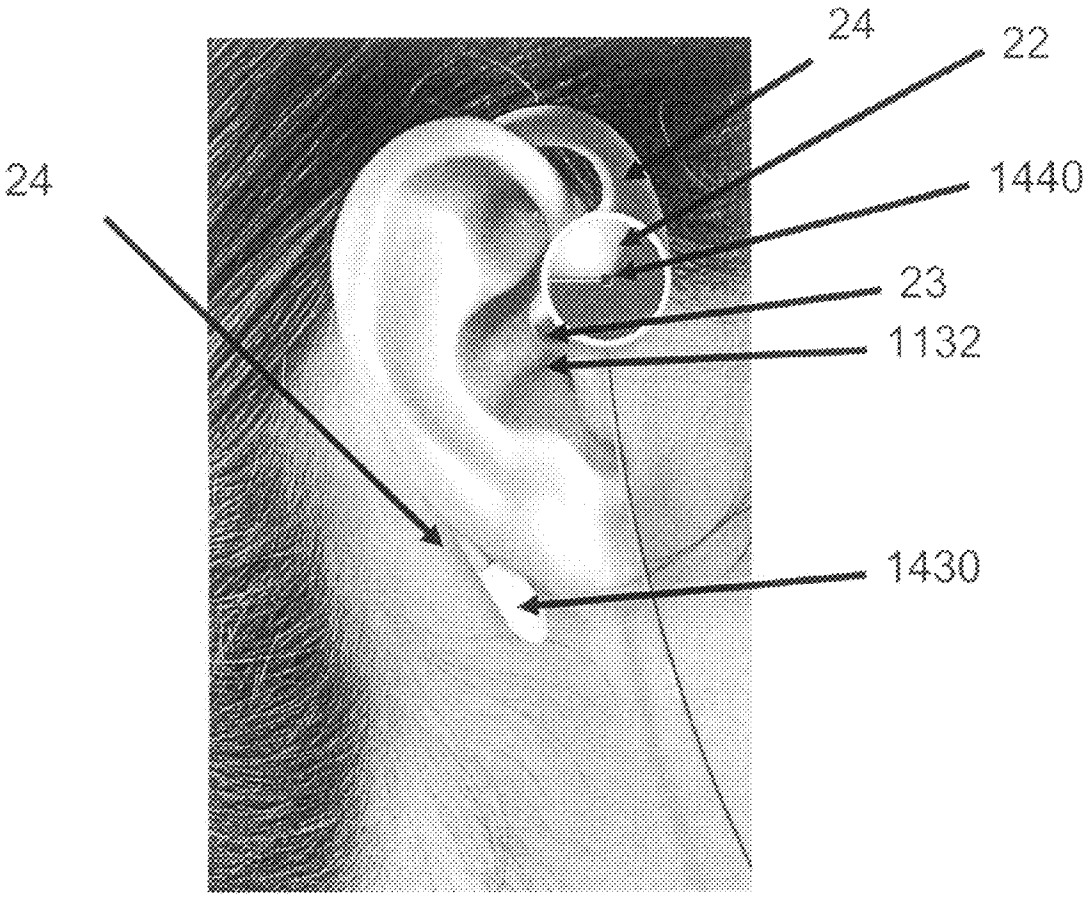
FIG. 7 is a side elevational view of a sound production device and a hook support according to the present disclosure disposed at an ear.

FIG. 7 illustrates additional features of a sound reproduction device 22. Here, a rigid transmission tube 23 directs sound toward lower concha 1132, where it is then picked up by the structures of the user's middle and inner ear. Again, support 24 curves around the user's ear, and is provided with an optional cap 1430 for comfort where the support rests against the bones of the skull.

A single air hole 1440 is shown in sound reproduction device 22, although multiple holes can be disposed at any point on the structure of the sound reproduction device 22. Hole 1440 is believed to improves sound quality by reducing echo within resonance spaces of the shell of the sound reproduction device 22, and can also further reduce sound pressure directed into the user's ear canal by allowing large sound pressure to escape away from the user's ear.

Figure 8:
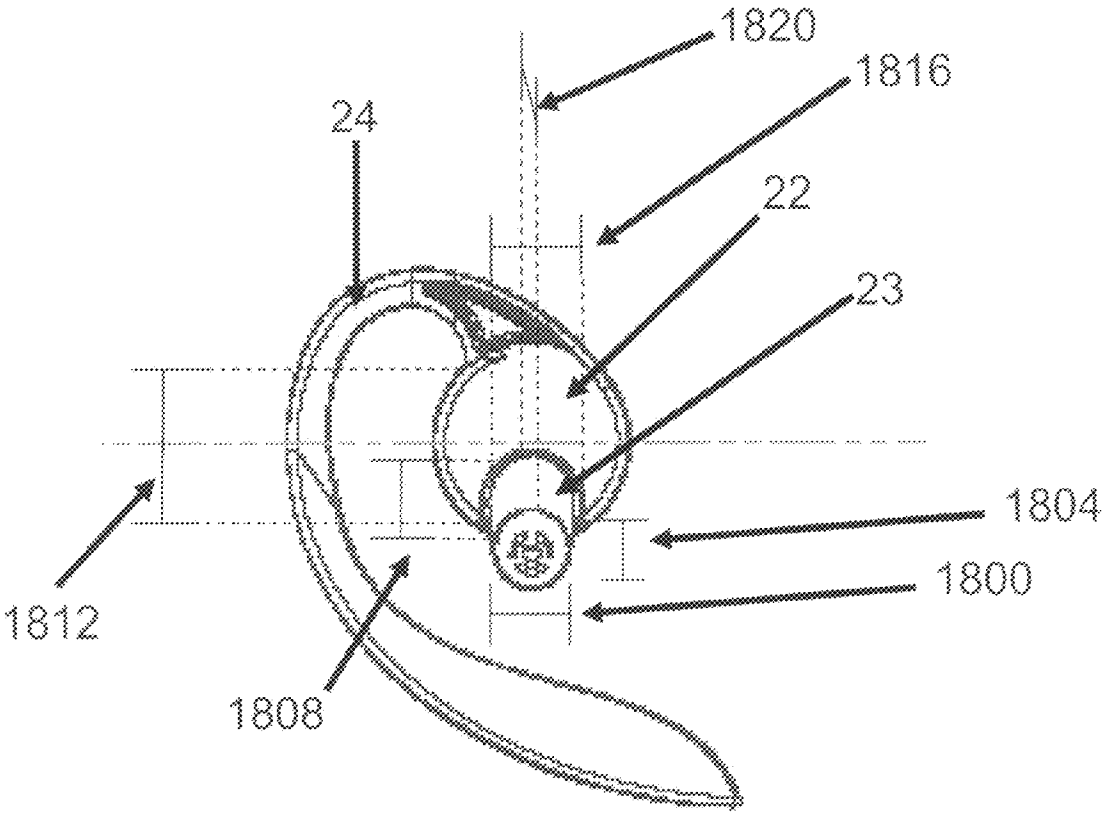
FIG. 8 is an enlarged side elevational view of an embodiment of a sound production device and a hook support according to the present disclosure, with various dimensions labeled.

FIG. 8 depicts the other side of sound reproduction device 22 of that shown in FIG. 7. In FIG. 8, dimensions of transmission tube 23 are given for exemplary purposes, although all variations of dimension are believed to be adequately supported by the present disclosure. Each dimension can be selected or optimized for sound production, where the length of the sound production tube, the size of the speaker and resonance space or spaces, and the sizes and shapes of the inner and outer apertures of the sound production tube all can have an effect on the frequency production and transmission characteristics of the sound reproduction device 22.

Dimension 1800 is the width of the transmission tube 23 at its outer terminus, and ranges from 2 mm to 10 mm, but in certain embodiments varies from about 4 mm to about 6 mm.

Dimension 1816 is the width of the transmission tube 23 at its inner terminus (where the tube meets the shell), and ranges from 2 mm to 10 mm, but in certain embodiments can be about 3 mm or about 5 mm or a width therebetween.

Dimension 1804 is the height of the transmission tube 23 at its outer terminus, and ranges from 2 mm to 10 mm, but in certain embodiments can be about 4 mm or about 6 mm or a height therebetween.

Dimension 1808 is the height of the transmission tube 23 at its inner terminus (where the tube meets the shell), and ranges from 2 mm to 10 mm, but in certain embodiments can be about 3 mm or about 5 mm or a height therebetween.

Dimension 1820 is the length of transmission tube 23, and ranges from 2 mm to 10 mm, but in certain embodiments can be about 2.8 mm or about 4 mm or a length therebetween.

Dimension 1820 is the length of transmission tube 23, and ranges from 2 mm to 10 mm, but in certain embodiments can be about 2.8 mm or about 4 mm or a length therebetween.

Dimension 1812 is the diameter of the shell housing the speaker, and ranges from 10 to 25 mm, but in certain embodiments can be about 15 mm or about 18 mm or a diameter therebetween.

In certain embodiments, transmission tube 23 is generally ovoid, and smaller at its inner terminus than at its outer terminus. Exemplary dimensions of transmission tube 23 is 3 mm×4 mm (height by width) at its inner terminus, and 5 mm×6 mm at its outer terminus. Transmission tube 23 is 2.8 mm long, and the shell can house a 15 mm speaker unit. Transmission tube 23 typically extends at a 45 degree angle from the speaker face. This configuration has been found to provide excellent sound quality, although others angles can be used.

Alternatively, transmission tube 23 can be 4 mm×5 mm (height by width) at its inner terminus, and 7 mm×8 mm at its outer terminus. Transmission tube 23 can be 4 mm long, and the shell can house a speaker unit that has a diameter of 18 mm.

Figure 9:
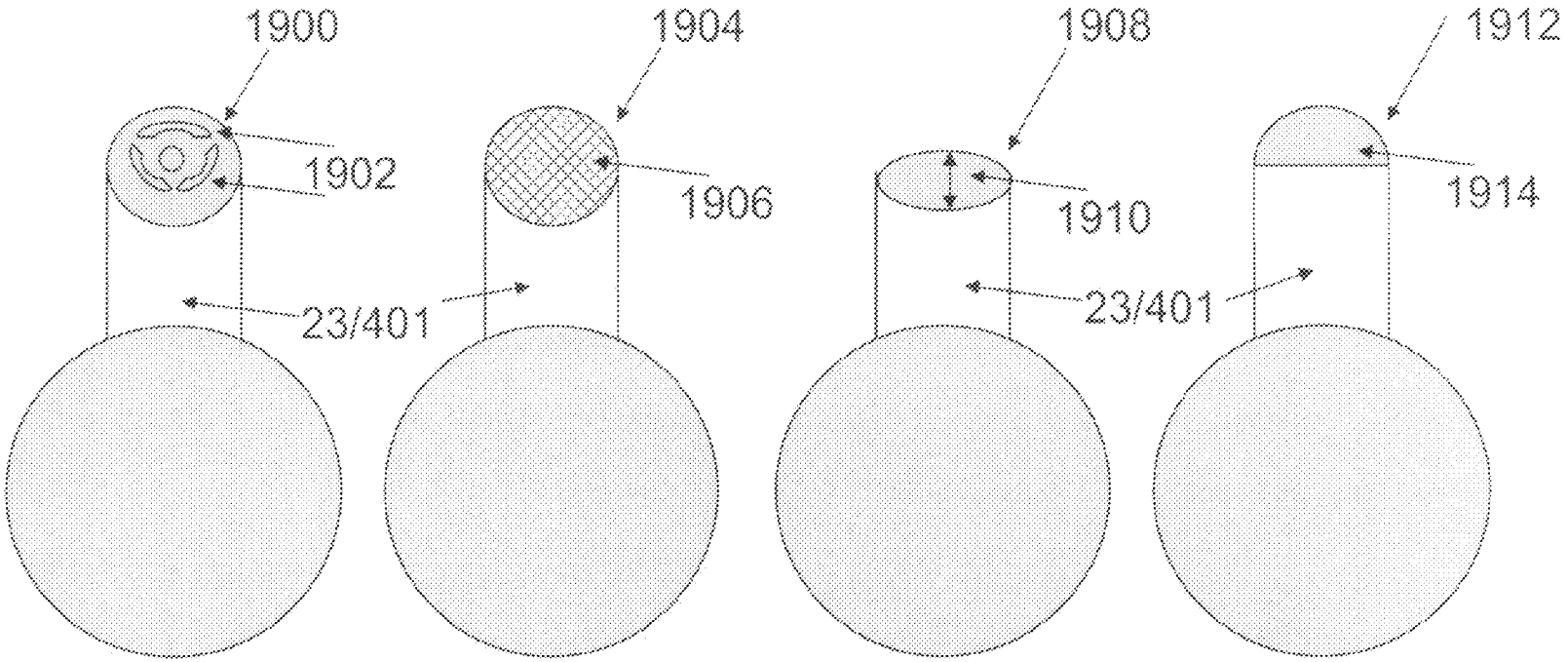
FIG. 9 is a schematic front elevational view of four distinct embodiments of a sound production device according to the present disclosure.

FIG. 9 shows some variations of covers that can be disposed at the outer terminus of transmission tube 23 (or transmission tube 401 as described in reference to FIG. 4). A cap 1900 comprising one or more holes or cutouts 1902 of various shapes is disposed at the end of transmission tube 23/401. A metal screen or mesh 1904 can alternatively be located at the end of transmission tube 23/401. These are some examples of covers, and other covers, including decorative covers, can be used. In general, a cover is used to keep debris and earwax out of the transmission tube 23/401 and to affect the sound quality produced therefrom, including plastic covers, silicone covers, metal mesh covers, metal grate covers, metal with holes of sufficient diameter and spacing to allow sounds through, gel covers, or any other material.

FIG. 9 also shows variations of transmission tube sizes and shapes. Transmission tube 23/401 can be ovoid-symmetric 1908, and narrower in one dimension 1910 than in another. Transmission tube can be hemispheric 1912, and flat on one edge 1914. Alternative shapes of the terminus of transmission tube 23/401 includes, but are not limited to, square, circular, arc, decorative (heart, star), isosceles triangular.

Generally, transmission tube 23/401 can have a narrow diameter to rest on the intertragic notch, or can otherwise hang in the auricular cartilage between the tragus and the anti-tragus. Transmission tube 23/401 can be straight or curved, and can increase or decrease in diameter or size as it extends away from the shell and toward the ear.

Transmission tube 23/401 can be rigid or flexible, and can comprise a soft material that can mold to a surface of the ear. Transmission tube 23/401 need not touch the ear at all, but can rest on any portion of the ear.

Although only one transmission tube 23/401 has been shown, multiple transmission tubes can be used for one speaker or for multiple speakers. In some aspects, multiple transmission tubes can point at different parts of the pinna to produce 3-d sound effects.

In general, transmission tube 23 can be made of any material, including plastic, metal, synthetic polymers, silicone, rubber, or rubberized or otherwise pliable materials. However, a softer material, such as silicone or a flexible plastic, is preferred for better comfort.

In general, any clip style can be used, including those disclosed above, and as non-limiting examples: glasses, clips that clip to the side of the ear, or as part of a headband or neckband. In general, any material can be used for the clip, including plastic, metal, synthetic polymers, silicone, rubber, or rubberized or otherwise pliable materials.

A volume control can be disposed on the wire.

A method for sound production according to the present disclosure includes receiving electrical signals corresponding to sound at a wire, generating sound at a speaker connected to the wire, resonating the sound in a cavity of a shell, and passing sound along a transmission tube toward a pinna of a user's ear without directing the sound directly toward the user's ear canal.

In the preceding detailed description, reference is made to the accompanying drawings, which form a part hereof, and in which are shown by way of illustration specific embodiments in which the subject matter can be practiced. In this regard, terminology such as "first," "then," "afterwards," "before," "next," "finally," "above," "below," "top," "bottom," "front," "back," "leading," "trailing," etc., is used with reference to the drawing being described. Because the processes and methods of the present subject matter can be performed in a number of different orders, and because the individual elements of the apparatus and systems of the present subject matter can be configured in a number of different orders, the above terminology is used for purposes of illustration and is in no way limiting. It is to be understood that other embodiments can be utilized and logical changes can be made without departing from the scope of the present subject matter. The preceding detailed description, therefore, is not to be taken in a limiting sense, and the scope of the present subject matter includes the full scope of the appended claims.

Although a number of discrete embodiments are described above, it is to be understood that these are merely non-limiting examples, and that any given embodiment of the subject matter can comprise some of the features of one shown embodiment, and/or some of the features of another shown embodiment. In the charts presented herewith, optional steps are illustrated in dashed lines. Other modifications between embodiments will be clear to one skilled in the art upon reading the preceding disclosure.

The previous description of some aspects is provided to enable any person skilled in the art to make or use the presently disclosed methods and apparatuses. Various modifications to these aspects will be readily apparent to those skilled in the art, and the generic principles defined herein can be applied to other aspects without departing from the spirit or scope of the invention. For example, one or more elements can be rearranged and/or combined, or additional elements can be added. Thus, the present invention is not intended to be limited to the aspects shown herein but is to be accorded the widest scope consistent with the principles and novel features disclosed herein.

The invention claimed is:

1. An earphone apparatus for sound production comprising:

a main body including a housing having a first space and a second space;

a sound transmitting tube extending outwardly from the housing and having a first end in sound communication with said first space and a second end having an outlet;

a speaker mounted within said housing between the first space and the second space, said speaker producing a resonance tone in the first space which is transmitted to the outlet by the sound transmitting tube; and a connection member disposed when said apparatus is in use such that the outlet of the sound transmitting tube is positioned to face an ear of a user such that the earphone does not directly occlude an ear canal of the ear of the user, and thus does not create a shutting stress.

2. The earphone apparatus as claimed in claim 1 wherein said connection member is comprised of a first mounting member attached on one side to said main body and a first magnet attached to the other side of said first mounting member, a resilient strap connected at one end to said first mounting member; and a second mounting member attached on one side to said strap and a second magnet attached to the other side of said second mounting member such that when in use said first and said second magnets are located on opposite sides of an earlobe of the user.

3. The earphone: apparatus as claimed in claim 1 wherein said connection member is an ear clip.

4. The earphone apparatus as claimed in claim 1 and further comprising first and second earphones; and further comprising first and second earphone wires respectively connected between a sound source and a corresponding one of said first and second earphones.

5. A sound production device comprising:

a first shell and a second shell collocated with the first shell, the first shell having a first space and the second shell having a second space so as to form an enclosed interior space;

a sound transmission tube extending outwardly from the first shell, the sound transmission tube having one end in sound communication with said first space of said first shell and a second end having an outlet via which sound exits from the sound transmission tube;

a speaker located within said interior space, and wherein said speaker can produce a sound which is transmitted to said one end of the sound transmission tube; and;

a connection member arranged to mount the sound production device to an ear of a user, wherein said sound production device provides sound to an ear of a user in which the ear has a pinna and an ear canal, and wherein said connection member connects said sound production device to an ear of a user such that said transmission tube second end is in contact with the pinna of the ear but does not extend into the ear canal and does not occlude the ear canal.

6. The sound production device as claimed in claim 5 wherein said transmission tube is rigid.

7. The sound production device as claimed in claim 5 wherein said transmission tube is made of a flexible plastic material.

8. The sound production device as claimed in claim 5 and further including a cover attached to said transmission tube second end, said cover having at least one hole therethrough.

9. A personal earphone that produces sound to an ear of a user comprising a hollow main body having a housing with an interior space and including a hollow sound transmitting tube extending outwardly from said housing with a first end in sound communication with said interior space, and a second end with an opening therein;

a speaker mounted in said interior space of said housing; and a connector for mounting said main body such that said sound transmitting tube second end when in use faces the ear of the user, but is not plugged into the ear of the user;

wherein the ear of the user has a pinna and an ear canal, and wherein when in use said sound transmitting tube second end is in contact with the pinna of the user and does not enter the ear canal.

10. The earphone as claimed in claim 9 wherein said housing has a first and a second shell collocated together and said speaker is mounted between said first and second shell, said first shell having a first space and said first end of said sound transmitting tube in fluid communication with said first space.

11. The earphone as claimed in claim 10 wherein said first and second shells are individual elements that are fixedly connected together.

12. The earphone as claimed in claim 9 wherein said earphone when in use does not occlude the ear canal of the ear of the user and does not completely cover the ear pinna.

13. The earphone as claimed in claim 9 and further including a wire that carries electrical sound signals, said wire being said electrically connected to said speaker, which generates sound corresponding to the electrical signals.

14. The earphone as claimed in claim 9 wherein said connector is an ear hanger that when in use can be mounted around the upper portion of the ear pinna so as to position said second end of said sound transmitting tube spaced proximate to but away from an opening of the ear canal such that said second end of said sound transmitting tube is positioned without directly contacting the ear canal of the ear of the user.

15. The earphone as claimed in claim 9 wherein said connector comprises two magnets and a flexible strap having two ends, one magnet and one end of the strap mounted on said body and said second magnet mounted on the other end of said strap such that said connector is mounted to the ear of the user by attaching the two magnets on either side of an earlobe of the pinna.

16. The earphone as claimed in claim 9 wherein when in use said earphone is connected to a source of sound and is mounted to one ear of a user and further comprising a second earphone that is mounted to a second ear of the user, said second earphone comprised of a hollow main body having a housing with an interior space and a hollow sound transmitting tube extending outwardly from said housing with a first end in sound communication with said interior space, and a second end with an opening therein;

a speaker mounted in said interior space of said housing; and a connector when in use for mounting said main body to the second ear of the user such that said sound transmitting tube second end when in use faces the second ear of the user, but is not plugged into the second ear of the user.

17. A personal earphone that produces sound to an ear of a user comprising:

a hollow main body having a housing with an interior space and including a hollow sound transmitting tube extending outwardly from said housing with a first end in sound communication with said interior space, and a second end with an opening therein;

a speaker mounted in said interior space of said housing; and a connector for mounting said main body such that said sound transmitting tube second end when in use faces the ear of the user, but is not plugged into the ear of the user;

wherein the ear of the user has a pinna and an ear canal; and wherein said housing has a first and a second shell collocated together and said speaker is mounted between said first and second shell, said first shell having a first space and said first end of said sound transmitting tube in fluid communication with said first space; wherein said first and second shells are individual elements that are fixedly connected together; and wherein when in use said sound transmitting tube second end is in contact with the pinna of the user and does not enter the ear canal, said earphone when in use does not occlude the ear canal of the ear of the user and does not completely cover the ear pinna.

18. A sound production device comprising:

a first shell and a second shell collocated with the first shell, the first shell having a first space and the second shell having a second space;

a sound transmitting tube extending outwardly from the first shell, the sound transmitting tube having an outlet at one end thereof via which sound exits from the sound transmitting tube;

a speaker located between the first space and second space, and wherein the speaker can produce a sound which is transmitted to the outlet of the sound transmitting tube; and a connection member arranged to mount the earphone to an ear of a user such that when said earphone is mounted to the ear, said tube outlet directs the sound towards a pinna of the ear, but such that said tube does not direct the sound toward an ear canal of the user, and such that said tube does not occlude the user's ear canal.

* * * * *